US005673909A

United States Patent [19]

Delorme et al.

[11] Patent Number: 5,673,909

[45] Date of Patent: Oct. 7, 1997

[54] NIP SET FOR REVERSIBLE FEEDING OF SINGLE SHEETS

[75] Inventors: John David Delorme; Glenn Frances Hawn, both of Spencerport, N.Y.

[73] Assignee: Eastman Kodak Company, Rochester, N.Y.

[21] Appl. No.: 627,521

[22] Filed: Apr. 4, 1996

[51] Int. Cl.[6] ..... B65H 9/16

[52] U.S. Cl. ..... 271/250; 271/273

[58] Field of Search ..... 271/273, 274, 271/248, 250, 251, 252, 245

[56] References Cited

U.S. PATENT DOCUMENTS

| | | | |
|---|---|---|---|
| 3,942,789 | 3/1976 | Townsend | 271/274 |
| 4,269,594 | 5/1981 | Umans et al. | 271/273 |
| 4,778,169 | 10/1988 | Fazio et al. . | |
| 5,031,895 | 7/1991 | Couper | 271/274 |
| 5,210,616 | 5/1993 | Kawasaki et al. . | |
| 5,322,273 | 6/1994 | Rapkin et al. . | |
| 5,382,013 | 1/1995 | Walsh . | |
| 5,484,142 | 1/1996 | Demange | 271/274 |

FOREIGN PATENT DOCUMENTS

| | | | |
|---|---|---|---|
| 63-57452 | 3/1988 | Japan . | |
| 403162344 | 7/1991 | Japan | 271/273 |
| 405069980 | 3/1993 | Japan | 271/274 |
| 6-1498 | 1/1994 | Japan . | |

*Primary Examiner*—H. Grant Skaggs
*Attorney, Agent, or Firm*—Nelson A. Blish

[57] ABSTRACT

Apparatus for advancing the cut sheets in an in-track direction to a sheet justification apparatus includes a driven roller and a gimbaled, self-aligning follower associated with the driven roller. The follower is movable between an engaged position, forming a nip with the driven roller, and a disengaged position, spaced from the driven roller. The follower is selectively movable to its engaged position to direct media from to the justification mechanism, to its disengaged position to allow the justification mechanism to justify the sheet, and back to its engaged position without introducing skew or shift as it re-engages the media to direct media from the justification mechanism without introducing skew or linear shift. The driven roller and the follower may be associated such that the media forms a wrap angle partially around the roller. The follower has a degree of freedom to rotate about an axis aligned with the direction of movement of the follower between its engaged position and its disengaged position. The follower is bi-directional, having a pair of rollers, one roller on one side of the axis in the direction of media travel and the other roller on the other side of the axis in the direction of media travel. The follower has a second and a third degree of freedom to rotate about a pair of orthogonal axes that are in a plane perpendicular to the axis aligned with the direction of movement of the follower.

5 Claims, 7 Drawing Sheets

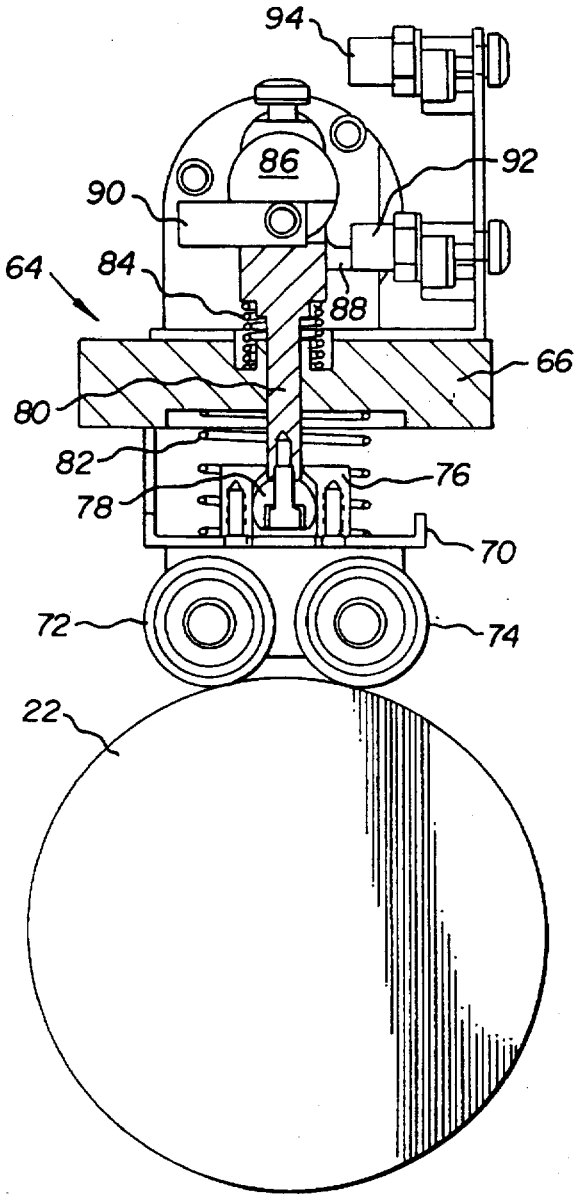
FIG. 5
FIG. 6
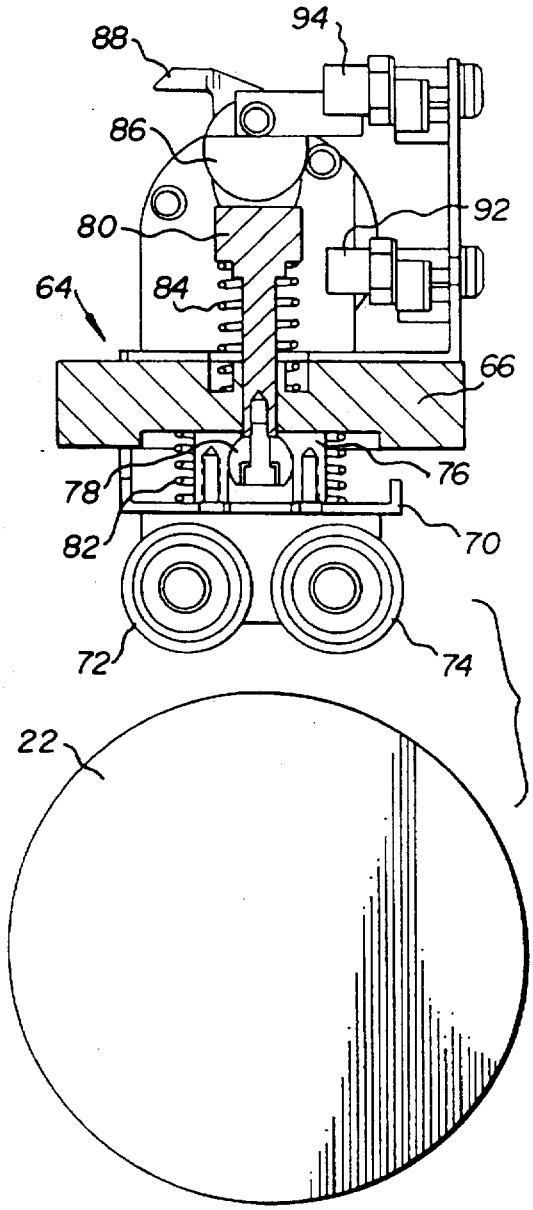

NIP SET FOR REVERSIBLE FEEDING OF SINGLE SHEETS

CROSS-REFERENCE TO RELATED APPLICATIONS

Reference is made to commonly assigned, co-pending U.S. patent Ser. No. 08/595,061, entitled CROSS-TRACK AND SKEW JUSTIFICATION OF CUT SHEETS, and filed in our names on Feb. 1, 1996.

BACKGROUND OF THE INVENTION

1. Technical Field

This invention relates generally to imaging apparatus, and more particularly to a bi-directional sheet advancing apparatus which disengages for cross-track and skew alignment of a sheet with an imaging drum, re-engages without moving the sheet, and does not impart directional forces upon the sheet.

2. Background Art

Single-sheet feeding of print media to an imaging drum requires accurate justification and alignment. The sheet handling system must not introduce forces that cause shift or skew of the media. Distortion, bending, or wrinkling of the media can seriously affect alignment as well as overall printer performance.

In a commercial color proofer, receiver and donor material is supplied from rolls, and cut to length. After cutting, the sheets are justified against an edge abutment along the path from the roll to the imaging drum. This arrangement gives the system an inherent element of control over media alignment. Rollers are typically used in these devices to guide the media by its edges to the imaging drum. However, roller design requires careful consideration of, and compensation for, cross-track forces and other effects that cause misalignment.

Existing transport methods are not well suited to the task of handling single-sheet media. Here, because sheet cross-track position is not constrained by a roller, the sheet must be separately aligned and justified for loading onto the imaging drum. This requires transport components that do not cause misalignment or skew. To keep the size of the system small, it is beneficial to have the same components handle the media before and after alignment. The problem of sheet alignment becomes especially acute when the transport system must handle sheet having different weight, thickness, and surface characteristics.

Existing large-format printers use a number of approaches for maintaining proper sheet alignment. Present roller or caster methods can still introduce considerable mechanical complexity, requiring the subsystem to incorporate compensation for parts near tolerance limits. Existing methods also use components such as casters that are uni-directional, and which therefore do not permit driving the media in opposed directions.

Approaches used in existing equipment such as high speed printers include nip sets that are continuously engaged or that include costly and complex compensation mechanisms. As a result, using conventional approaches for media transport can result in considerable expense and require difficult mechanical adjustments in manufacture and service.

DISCLOSURE OF THE INVENTION

It is an object of the present invention to provide a gimbaled dual-roll follower that can be engaged to direct media sheets from an initial picking and routing mechanism to a justification mechanism without introducing skew or linear shift in the process, and to be disengaged without causing misalignment to allow the justification mechanism to line up the sheets so that it is perpendicular with the imaging drum and shifts the medial linearly so that it registers with its proper position on the drum.

It is another object of the present invention to provide a bi-directional follower that allows the follower to re-engage once the media is justified. The sheet can then be driven in the reverse direction, held justified by the follower, for feeding onto the imaging drum.

It is still another object of the present invention provide for the follower to be self-aligning so that it does not introduce skew or shift as it re-engages the media.

According to a feature of the present invention, apparatus for advancing the cut sheets in an in-track direction to a sheet justification apparatus includes a driven roller and a gimbaled, self-aligning follower associated with the driven roller. The follower is movable between an engaged position, forming a nip with the driven roller, and a disengaged position, spaced from the driven roller. The follower is selectively movable to its engaged position to direct media to the justification mechanism, to its disengaged position to allow the justification mechanism to justify the sheet, and back to its engaged position without introducing skew or shift as it re-engages the media to direct media from the justification mechanism without introducing skew or linear shift.

According to a preferred embodiment of the present invention, the driven roller and the follower are associated such that the media forms a wrap angle partially around the roller. The follower has a degree of freedom to rotate about an axis aligned with the direction of movement of the follower between its engaged position and its disengaged position. The follower is bi-directional, having a pair of rollers, one roller on one side of the axis in the direction of media travel and the other roller on the other side of the axis in the direction of media travel. The follower has a second and a third degree of freedom to rotate about a pair of orthogonal axes that are in a plane perpendicular to the axis aligned with the direction of movement of the follower.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIGS. 5 and 6 are side views of the detail of FIG. 4, showing the apparatus in two different stages of operation;

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
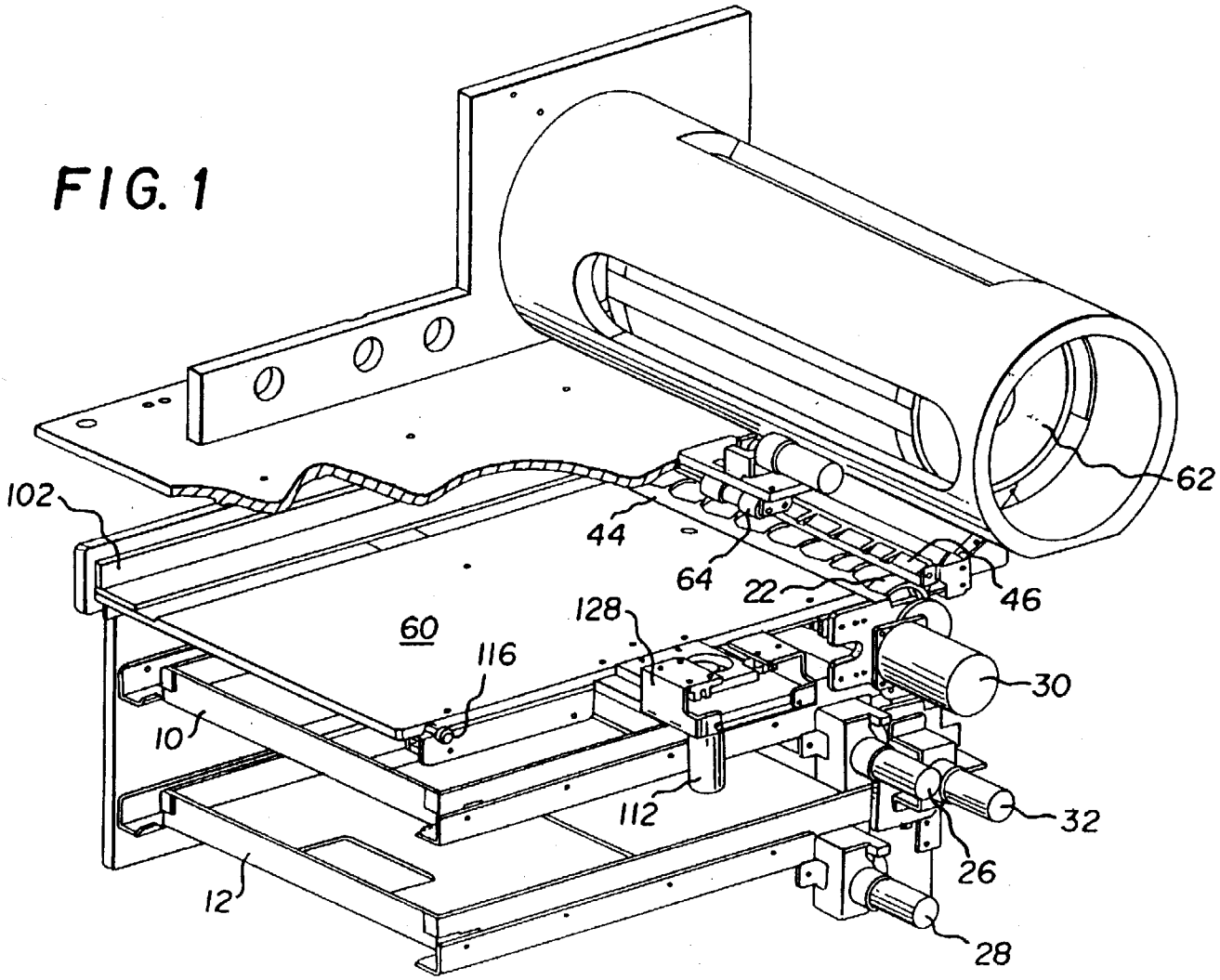
FIG. 1 is a perspective view, partially broken away, of imaging apparatus according to the present invention.
Figure 2:
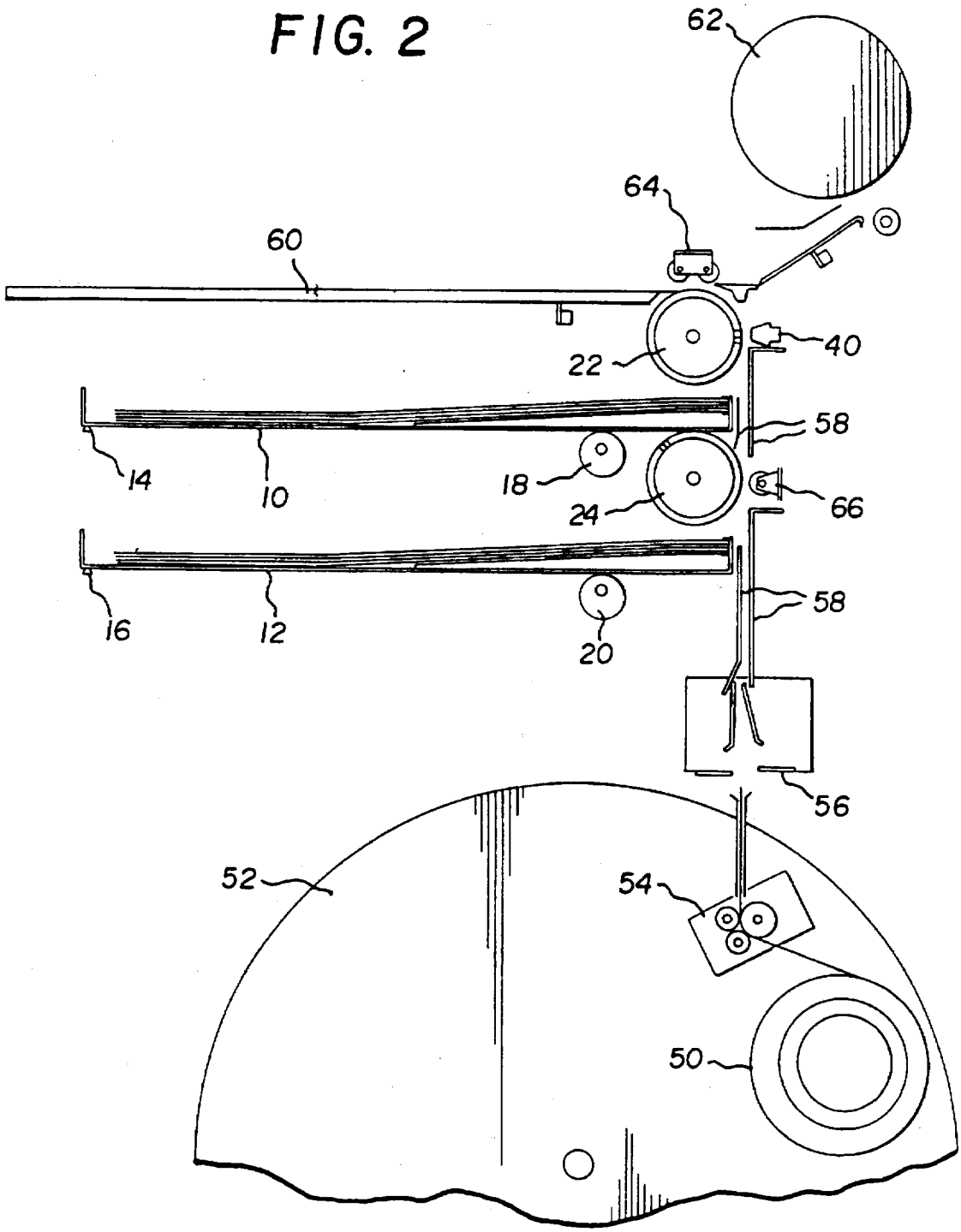
FIG. 2 is a schematic side view of the imaging apparatus of FIG. 1.

Referring to FIGS. 1 and 2, the imaging apparatus is provided with at least one receiver sheet tray. Two trays 10 and 12 are illustrated for either different receiver sheet characteristics or to provide a reserve tray which can be used when the main tray is empty and being re-loaded. Each tray 10 and 12 can be raised about a pivot point 14 and 16, respectively, by a cam 18 and 20 (FIG. 2) to bring the leading edge of the top sheet in the tray into contact with a rotary vacuum tube 22 and 24. Cams 18 and 20 are driven by motors 26 and 28, respectively, and rotary vacuum tubes 22 and 24 are driven by a stepper motor 30 and a gear motor 32, respectively (FIG. 1).

Figure 3:
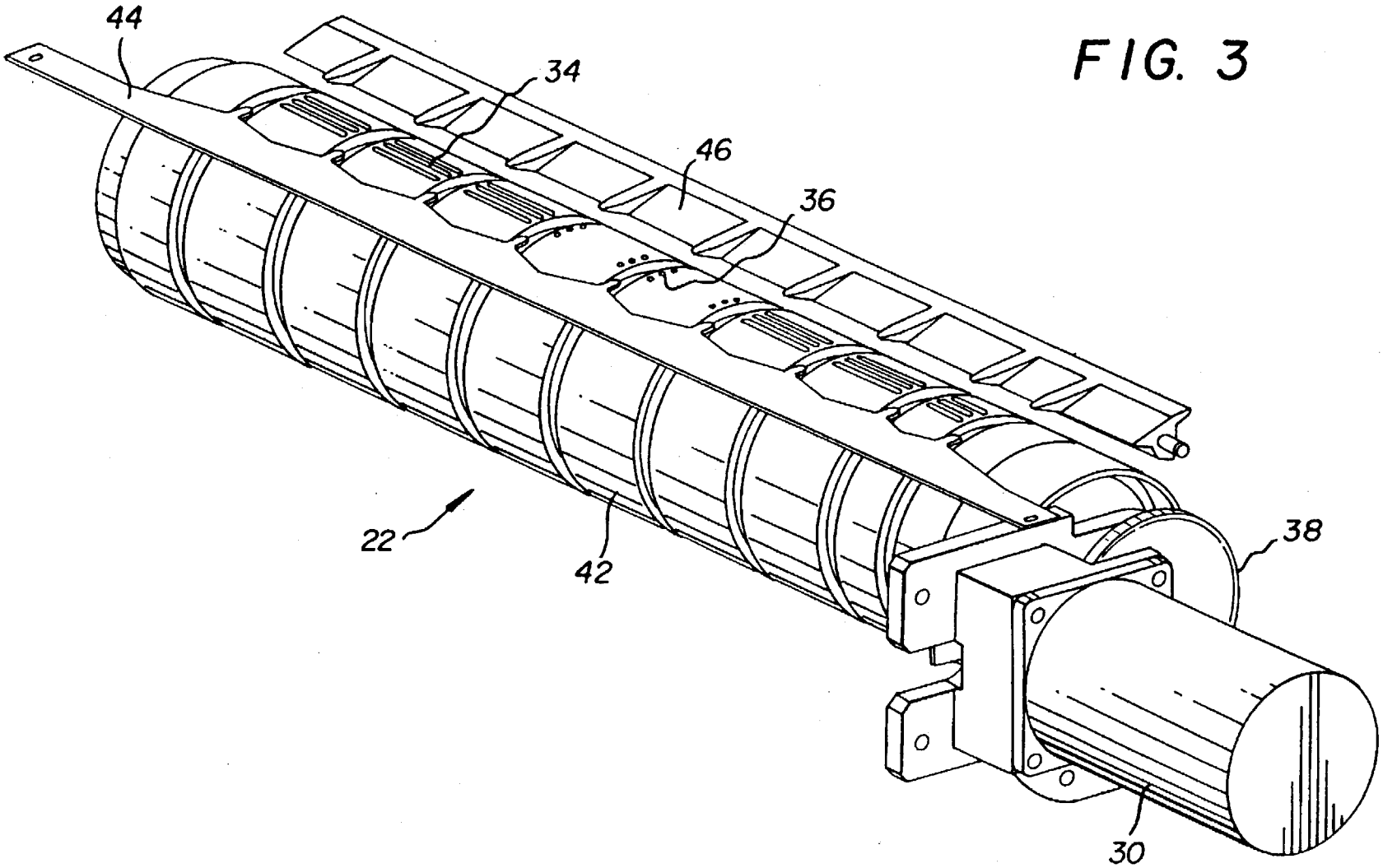
FIG. 3 is a perspective view of a detail of the imaging apparatus of FIG. 1.

Referring to FIG. 3, top rotary vacuum tube 22 has a plurality of vacuum slots 34 and vacuum holes 36. A slot at end 38 of tube 22 is detected by a sensor 40 (FIG. 2) to flag the tube's "home" position. A series of rubber compound surfaces 42 are molded onto an aluminum tube to increase friction drive for the cut sheets. A fixed skive bar 44 and a two-position skive bar 46 are provided.

Donor media is supplied from rolls (one roll 50 being illustrated in FIG. 2) carried on a rotating carousel 52. Each roll is associated with a feeder mechanism 54. When a donor sheet is required, the proper roll is indexed into alignment with a knife mechanism 56. The donor material is feed along a series of guides 58, and a sheet is trimmed by the knife mechanism.

In general, a receiver sheet is first delivered from one of the trays 10 and 12 to a justification tray 60. The sheet is cross-track aligned and skew corrected in the justification tray, which is described in commonly assigned, co-pending U.S. patent Ser. No. 08/595,061, entitled CROSS-TRACK AND SKEW JUSTIFICATION OF CUT SHEETS, and filed in our names on Feb. 1, 1996. The disclosures of this application is hereby expressly incorporated herein. Next, the sheet is then advanced to an imaging platen, such as a drum 62.

Figure 4:
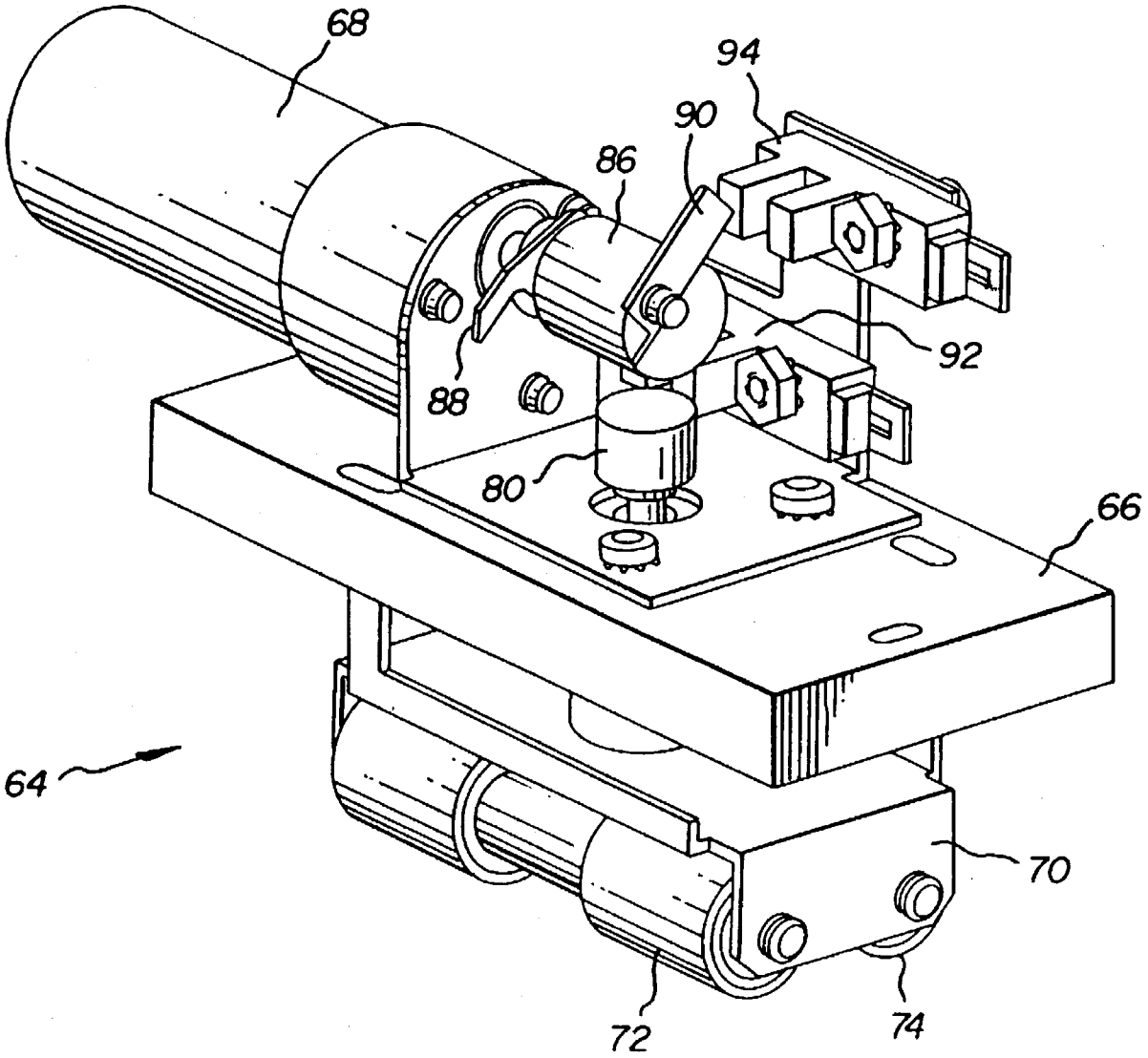
FIG. 4 is a perspective view of another detail of the present invention.

The media is selectively held to rotary vacuum tube 22 by a gimbaled nip set 64. The nip set, best seen in FIGS. 4–6, includes a mounting plate 66 to which a small dc motor 68 (or, alternatively, a low-profile solenoid) is attached. A carriage 70 supports two idler rollers 72 and 74 on a cylindrical socket assembly 76 (FIGS. 5 and 6).

Socket assembly 76 captures a ball 78 which is screwed to the lower end of a plunger 80. A spring 82 in compression between mounting plate 66 and carriage 70 urges the plate and carriage apart. Another spring 84 urges plunger 80 to the top of its travel relative to mounting plate 66 so that ball 78 is raised against the force of spring 82 by spring with carriage 70 and idler rollers 72 and 74 traveling with the plunger and ball. Plunger 80 is moved down against the force of spring 84 by an eccentricity mounted cam roller 86 on the shaft of motor 68. In the lowered position, there is lost-motion space between ball 78 and the top of cylindrical socket assembly 76.

A pair of flags 88 and 90 and associated optical sensors 92 and 94, respectively are provided for detecting which positions the plunger and the carriage are in. In the lowered position, spring 82 loads rollers 72 and 74 against rotary vacuum tube 22 so that the rotary vacuum tube moves media in either a forward or backward direction.

The ball and socket arrangement allows nip set 64 to pivot and rotate about the ball for a gimbaled effect; allowing rotation about three orthogonal axes centered on the ball, one of the axes being aligned with the direction of travel of plunger 80. That is, carriage 70 can rotate and/or rock to any position required by tolerance variations to align correctly to rotary vacuum tube 22. The gimbaled nip set design forces rollers 72 and 74 to find the surface of the rotary vacuum tube and engage it squarely. As the nip set is lowered, the initial point of contact of the rollers act as a pivoting point, allowing the nip set to straighten and lie fully against the rotary vacuum tube. The rollers follow the rotation of the rotary vacuum tube as long as they remain engaged, eliminating any skew or shift in the media. Spring 82 stabilizes the nip set rotational movement and provides enough resistance to keep the roller axes parallel the axis of the rotary vacuum tube. Because the roller axes are parallel to the axis of the rotary vacuum tube, the nip set does not introduce any directional effects while the rotary vacuum tube rotates.

FIG. 5 shows the raised position of the carriage. With the rollers disengaged from rotary vacuum tube 22, the rotary vacuum tube rotates to bring the lead edge of a media sheet beneath nip set 64. Carriage 70 is then lowered, which causes the rollers to press against the media as the vacuum tube rotates. The rotary vacuum tube then releases vacuum pressure with which it held the lead edge of the sheet. The rotary vacuum tube now acts as the drive roller, and its rotation with the roller engaged brings the media sheet forward to justification tray 60.

Once the media sheet is well within the justification tray, nip set 64 is disengaged so that the sheet can be cross-track aligned and skew corrected in the justification tray (as explained below). After justification is complete, the nip set is re-engaged. Rotary vacuum tube 22 then rotates in the other direction (clockwise as illustrated), guiding the media forward, toward drum 62.

Figure 7:
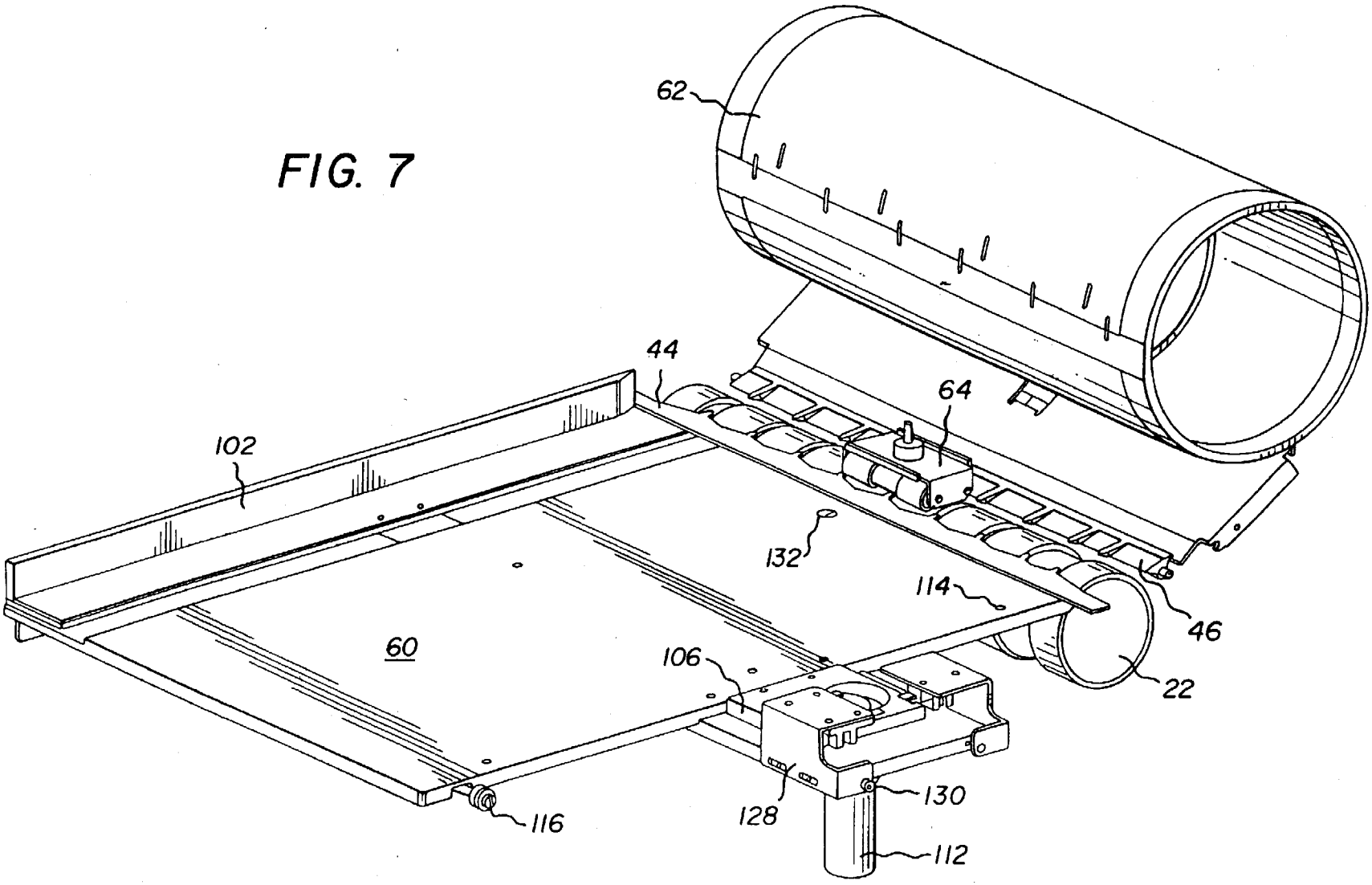
FIG. 7 is a perspective view of another detail of the imaging apparatus of FIG. 1.

Details of justification tray 60 will be discussed with particular reference to FIGS. 7 and 8. A sheet guide mechanism is supported below tray 60. The guide mechanism includes a movable justification edge abutment 102 attached to a guide bar 104 that slides below tray 60. The end of the guide bar opposite to justification edge abutment 102 carries a cam plate 106 with a slot 108. An eccentric cam wheel 110 is driven by an electric cam motor 112. The angular orientation of tray 60 about a vertical axis at 114 can be adjusted by a screw 116 (FIGS. 1 and 3) to keep justification edge abutment 102 parallel to a line which is perpendicular to the rotary axis of rotary vacuum tube 22.

Figure 8:
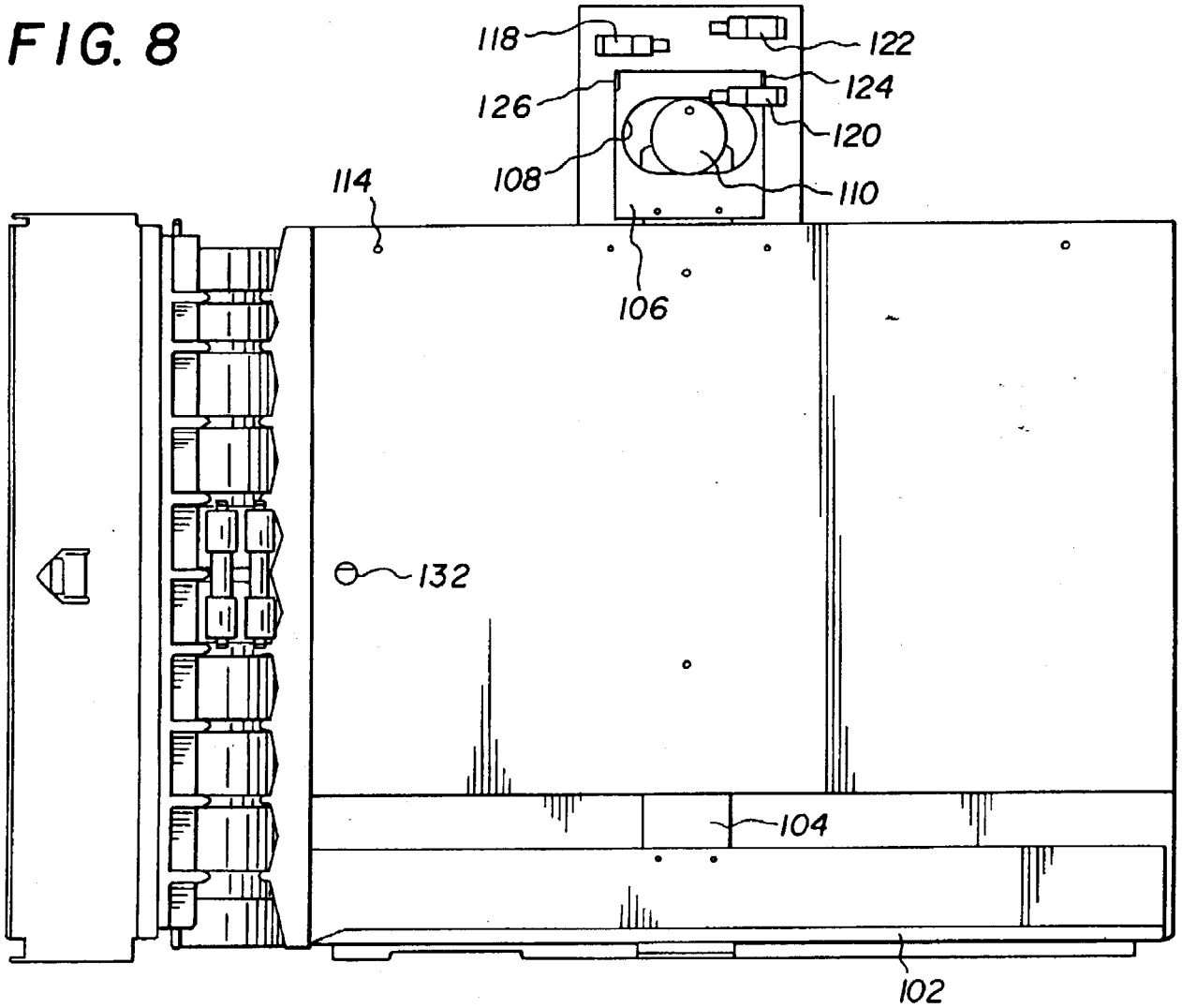
FIG. 8 is a top view of a detail of the imaging apparatus of FIG. 1.

Best seen in FIG. 8, there are three optical sensors 118, 120, and 122. Home sensor 120 detects the presence of a flag 124, while donor sensor 118 and receiver sensor 122 detect the positions of flags 126 and 124, respectively. The flags are attached to and move with guide bar 104 and justification edge abutment 102. The sensors are carried on a bracket 128 which can be adjusted by a screw 130.

Operation of the apparatus during a receiver sheet feed cycle will be explained with respect to FIGS. 1 to 5. At the start of a sheet feed cycle, cam motor 112 is turned on to extend justification edge abutment 102 to clear tray 60 for a receiver sheet. The correct position of the cam is identified when flag 124 breaks the beam of home position optical sensor 120.

Rotary vacuum tubes 22 and 24 operate, with vacuum on, to pick up a receiver sheet from one of the supply trays 10 and 12. The rotary vacuum tube then is rotated by motor 30 or 32 to guide the sheet edge into position so that it can be clamped under nip set 64 or 66, respectively. For receiver in top tray 14, this requires rotation of rotary vacuum tube 22 by 180 degrees. For receiver in bottom tray 12, rotation of only 120 degrees is required.

Once the receiver is under a nip set, the nip set engages. Now, the rotary vacuum tube vacuum turns off, and the rotary vacuum tube acts only as a drive roller for advancing the receiver sheet to justification tray 60. The leading edge of the receiver sheet is stripped from the rotary vacuum tube by a skive bar 44. Arrival of the leading edge of the receiver sheet at a predetermined position on justification tray 60 is detected by an optical sensor 132. Depending on the in-track length of the sheet, machine logic sets the distance that rotary vacuum tube 22 will drive the sheet; leaving the trailing edge of the sheet between the rotary vacuum tube and nip set 64.

The nip set now disengages, leaving the sheet unconstrained on justification tray 60. Justification motor engages and justification edge abutment 102 are pulled toward the sheet until receiver optical sensor 122 is tripped by flag 124, squaring the receiver to the justification edge abutment in the process. When flag 124 trips sensor 122, the center of the receiver sheet is aligned with a predetermined axial position along imaging drum 62 as determined by the previously-mentioned adjustment of home sensor 120.

Nip set 64 is again engaged to hold the receiver sheet to rotary vacuum tube 22 in the squared and centered location. Motor 112 is engaged to return justification edge abutment 102 to the home position. Nip set 64 engages and the receiver sheet is driven off the justification tray and is stripped from the rotary vacuum tube by a second skive bar 46 for delivery to imaging drum 62.

Assuming that cam motor 112 has driven eccentric cam 110 to extend justification edge abutment 102 to clear tray 60 for a donor sheet, donor feeder mechanism 54 (FIG. 2) feeds donor web to rotary vacuum tubes 24 and 22, and the web is trimmed by knife mechanism 56. Rotary vacuum tube 22 acts as drive roller for advancing the donor sheet to justification tray 60. The leading edge of the donor sheet is stripped from the rotary vacuum tube by skive bar 44. Arrival of the leading edge of the donor sheet at a predetermined position on justification tray 60 is detected by optical sensor 132. Machine logic sets the distance that rotary vacuum tube 22 will drive the donor sheet; leaving the trailing edge of the sheet between the rotary vacuum tube and nip set 64.

The nip set now disengages, leaving the donor sheet unconstrained on justification tray 60. Justification motor engages and justification edge abutment 102 are pulled toward the donor sheet until receiver optical sensor 122 is tripped by flag 124, squaring the receiver to the justification edge abutment in the process. When flag 124 trips sensor 122, the center of the donor sheet is aligned with the afore-mentioned predetermined axial position along imaging drum 62 as determined by the previously-mentioned adjustment of home sensor 120.

Nip set 66 is again engage to hold the donor sheet to rotary vacuum tube 22 in the squared and centered location. Motor 112 is engaged to return justification edge abutment 102 to the home position. The donor sheet is driven off the justification tray and is stripped from the rotary vacuum tube by second skive bar 46 for delivery to imaging drum 62.

Advantages

The present invention provides a compact and simple means of driving media in a way that preserves its alignment. Because it is inherently bi-directional, the nip set maintains alignment into and out from the justification mechanism without requiring additional components.

Because the nip set holds the media in the center, this design eliminates possible directional force differences that could cause misalignment, skew, or distortion of the media. The design does not require tight tolerances in manufacture or assembly and does not include sensitive components that require field adjustment.

The engagement mechanism needs apply only enough pressure to hold the nip set firmly against the drum. Wide tolerance is permitted for this holding pressure, allowing an inexpensive dc motor or solenoid to be used for engagement.

Possible adverse directional forces that might cause skew are minimized, and possible problems with uneven parts wear and eliminated. Roller implementation provides for consistent, even wear and reliable performance for the full useful life of the printer.

The invention has been described in detail with particular reference to preferred embodiments thereof, but it will be understood that variations and modifications can be effected within the spirit and scope of the invention.

What is claimed is:

1. Apparatus for receiving cut sheets, for advancing the cut sheets in an in-track direction, and for justifying the cut sheets for cross-track directional and skew alignment; said apparatus comprising:

a justification mechanism adapted to align a cut sheet in a cross-track direction and to remove skew misalignment of the cut sheets:

a driven roller;

a gimbaled, self-aligning follower associated with the driven roller and movable between an engaged position forming a nip with the driven roller and a disengaged position spaced from the driven roller; and selectively operated means for moving the follower (i) to its engaged position to direct media to the justification mechanism, (ii) to its disengaged position to allow the justification mechanism to justify the sheet, and (iii) to its engaged position without introducing skew or shift as it re-engages the media to direct media from the justification mechanism without introducing skew or linear shift in the process.

2. A justification apparatus as set forth in claim 1 wherein the driven roller and the follower are associated such that the media forms a wrap angle partially around the roller.

3. Apparatus for receiving cut sheets, for advancing the cut sheets in an in-track direction to a justification apparatus for cross-track directional and skew alignment of the cut sheets; said apparatus comprising:

a driven roller;

a gimbaled, self-aligning follower associated with the driven roller and movable between an engaged position forming a nip with the driven roller and a disengaged position spaced from the driven roller; and selectively operated means for moving the follower (i) to its engaged position to direct media to the justification mechanism, (ii) to its disengaged position to allow the justification mechanism to justify the sheet, and (iii) to its engaged position without introducing skew or shift as it re-engages the media to direct media from the justification mechanism without introducing skew or linear shift in the process, wherein the follower has a degree of freedom to rotate about an axis aligned with the direction of movement of the follower between its engaged position and its disengaged position.

4. A justification apparatus as set forth in claim 3 wherein the follower is bi-directional, having a pair of rollers, one roller on one side of the axis in the direction of media travel and the other roller on the other side of the axis in the direction of media travel.

5. A justification apparatus as set forth in claim 3 wherein the follower has a second and a third degree of freedom to rotate about a pair of orthogonal axes that are in a plane perpendicular to the axis aligned with the direction of movement of the follower.

* * * * *